US006216273B1

(12) United States Patent
Williams

(10) Patent No.: US 6,216,273 B1
(45) Date of Patent: Apr. 17, 2001

(54) HEAVENLY WONDERS NURSING BLANKET

(75) Inventor: Cherilyn Elaine Williams, Jefferson City, MO (US)

(73) Assignee: Cherilyn Williams, Jefferson City, MO (US)

( * ) Notice: Subject to any disclaimer, the term of this patent is extended or adjusted under 35 U.S.C. 154(b) by 0 days.

(21) Appl. No.: 09/347,392

(22) Filed: Jul. 6, 1999

(51) Int. Cl.[7] ..... A41D 1/20
(52) U.S. Cl. ..... 2/104
(58) Field of Search ..... 2/104, 111, 48, 2/55, 92, 88, 120, 270, 49; D2/823

(56) References Cited

U.S. PATENT DOCUMENTS

| | | | | |
|---|---|---|---|---|
| 4,468,816 | * | 9/1984 | Kaufer | 2/104 |
| 4,651,349 | * | 3/1987 | Heiler | 2/104 |
| 4,712,251 | * | 12/1987 | Cobble | 2/49 |
| 4,964,172 | * | 10/1990 | Bollard | 2/104 |
| 4,989,268 | * | 2/1991 | Stolhand | 2/104 |
| 5,038,411 | * | 8/1991 | St. Armand | 2/104 |
| 5,042,090 | * | 8/1991 | Cook | 2/69 |
| 5,479,662 | * | 1/1996 | Runco | 2/104 |
| 5,570,474 | * | 11/1996 | Berry et al. | 2/104 |
| 5,592,692 | * | 1/1997 | Larson | 2/104 |
| 5,652,958 | * | 8/1997 | Farrell-Mestas | 2/48 |
| 5,652,960 | * | 8/1997 | Kaknevicius | 2/104 |
| 5,848,439 | * | 12/1998 | Huseth et al. | 2/104 |
| 5,893,171 | * | 4/1999 | Ries | 2/48 |
| 5,956,762 | * | 9/1999 | Adams | 2/48 |

* cited by examiner

*Primary Examiner*—John J. Calvert
*Assistant Examiner*—Alissa L. Hoey
(74) *Attorney, Agent, or Firm*—Richard Grundstrom

(57) ABSTRACT

A nursing blanket and method for covering the torso, and exposed breast of a nursing mother and the head of the feeding infant, to provide privacy and coverage while breast-feeding. The blanket is comprised of a single thickness fabric blanket, the main body or midsection of which is an oval. The ends of the blanket are attached to a shoulder strap on one end, and an arm sleeve on the opposing end. The shoulder strap is comprised of a double thickness of stretch-able knit material which is sewn into a narrow strip and curved back on itself to form a loop. This loop fits over the mother's hand and slides up the arm, to be secured on her shoulder, opposite the breast which will be used for nursing. The arm sleeve on the opposing end of the blanket slides over the mothers remaining hand and rests on the forearm. The infant's head rests on the arm which is covered by the sleeve, and the blanket then comes up and over the baby's head, and crosses his body. When the infant is positioned on the mother's lap for nursing, the body of the blanket covers the mother's torso, as well as the infant's head and the majority of the infants body.

8 Claims, 4 Drawing Sheets

FIG. 2
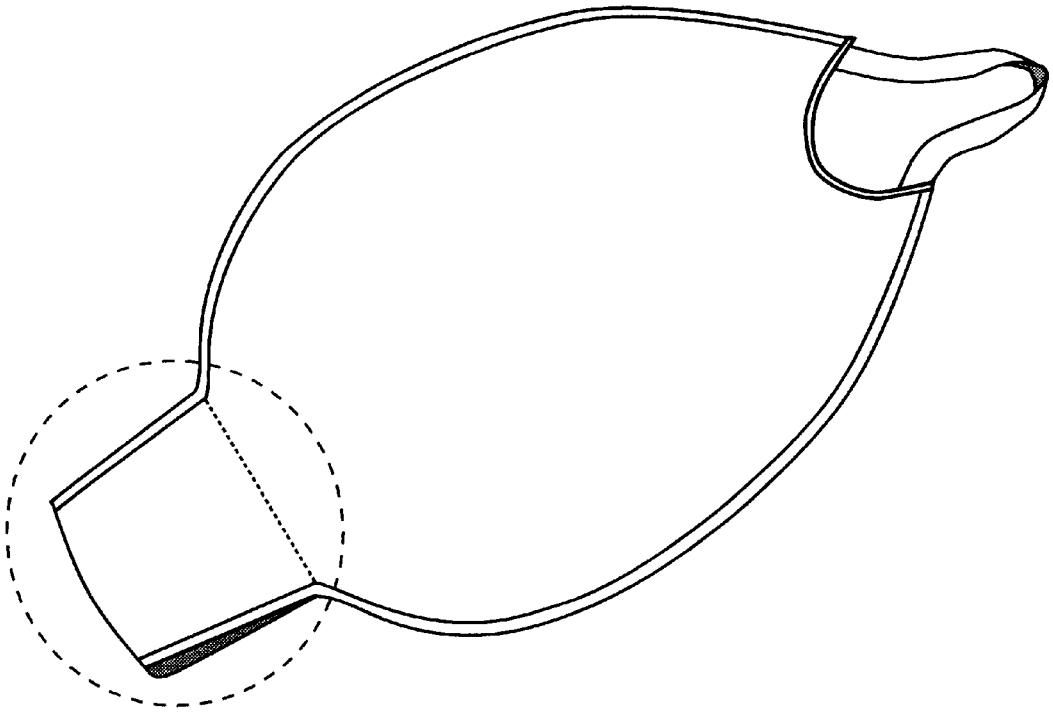
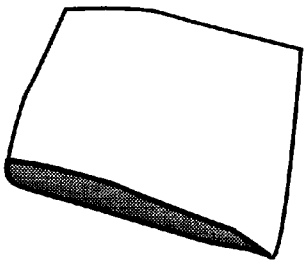
20
FIG 2A
FIG 2B
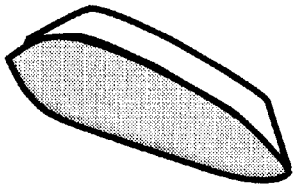
22

*Note: shaded areas denote wrong side of fabric.*

HEAVENLY WONDERS NURSING BLANKET

BACKGROUND

This invention relates to childcare and breast-feeding, and in particular to blankets for use by nursing mothers to provide coverage and privacy during breast-feeding.

Typically, nursing mothers have used a basic, flat, rectangular infant blanket as a means of coverage in instances when they are required to breast-feed their baby in public and want to cover their breast from onlookers. This basic rectangular blanket is thrown over the shoulder and baby, but can fall off and does not stay in place and the breast can be revealed, thus privacy is not achieved. Prior art such as the "Privasee Blanket" provides an attachment at only one point of the mothers body, but all other surfaces of the blanket are free. Thus the blanket can still be moved or kicked aside by the baby, thus potentially uncovering the mother's breast.

Both a basic blanket and the Privasee Blanket have difficulty in covering the mother's breast during breast-feeding in a manner which can be maintained about the infant and breast over the duration of the feeding, as the infant moves its arms and kicks its legs about. They both require the mother to continually replace and rearrange the blanket. Therefore, what is needed is a blanket that can be easily manipulated by the mother and quickly put on, and also securely cover the mother's breast during nursing, without falling off.

SUMMARY

The nursing blanket, of this patent is designed to provide privacy for breast feeding mothers while they nurse their babies in instances where privacy is not otherwise possible. The main function of this blanket is to provide cover that will stay in place and not slide out of position, thus exposing the breast or nursing infant. The blanket's design allows the mother to cover her breast and infant while the infant is nursing. The blanket stays in place, while the mother's hands are free and the mother is able to view the infant while nursing.

It is comprised of a single-layer, fabric blanket which is symmetrically shaped as an oval. The ends of the blanket are attached to a shoulder strap on one end, and an arm sleeve at the opposing end. Typically, when nursing an infant, the mother will rest the infant's head on the arm at the same side of the body of which breast the baby will be nursing. When using the nursing blanket, the mother slips her arm through the arm sleeve, and then rests that same arm under the baby's head, the same way she would if she were nursing without a blanket.

The blanket then extends from the arm sleeve fitted around the mother's arm, and under the baby's head, and wraps around the infant's head and torso. The opposite end of the blanket lays over the infant's feet, and tapers into a stretchable shoulder strap, which slips over the mother's hand, and onto her shoulder, thus allowing the coverage of the blanket over the infant and breast to remain in place while the infant is nursing.

OBJECTS AND ADVANTAGES

Objects and advantages of the invention are:

a. to provide a coverage of the mother's breast and nursing infant while feeding the infant.

b. to provide a coverage that does not become misplaced during the feeding by the baby's or the mother's movement.

c. to provide a covering that allows the mothers hands to remain free while nursing.

d. to provide a blanket that does not have to be continually replaced when it falls off due to movement.

e. to provide encouragement to nursing mothers by providing a useful tool for breast-feeding in situations where privacy is not an option.

Still further advantages will become apparent from a consideration of the ensuing descriptions and drawings.

BRIEF DESCRIPTION OF THE DRAWINGS

FIG. 2 shows again a full flat view of the invention, with the arm sleeve being highlighted.

FIG. 2A is a perspective view showing the sleeve is a hollow open piece with openings on either end.

FIG. 2B is a perspective view showing the sleeve from a side view, displaying an opening at one end.

DETAILED DESCRIPTION

Figure 1:
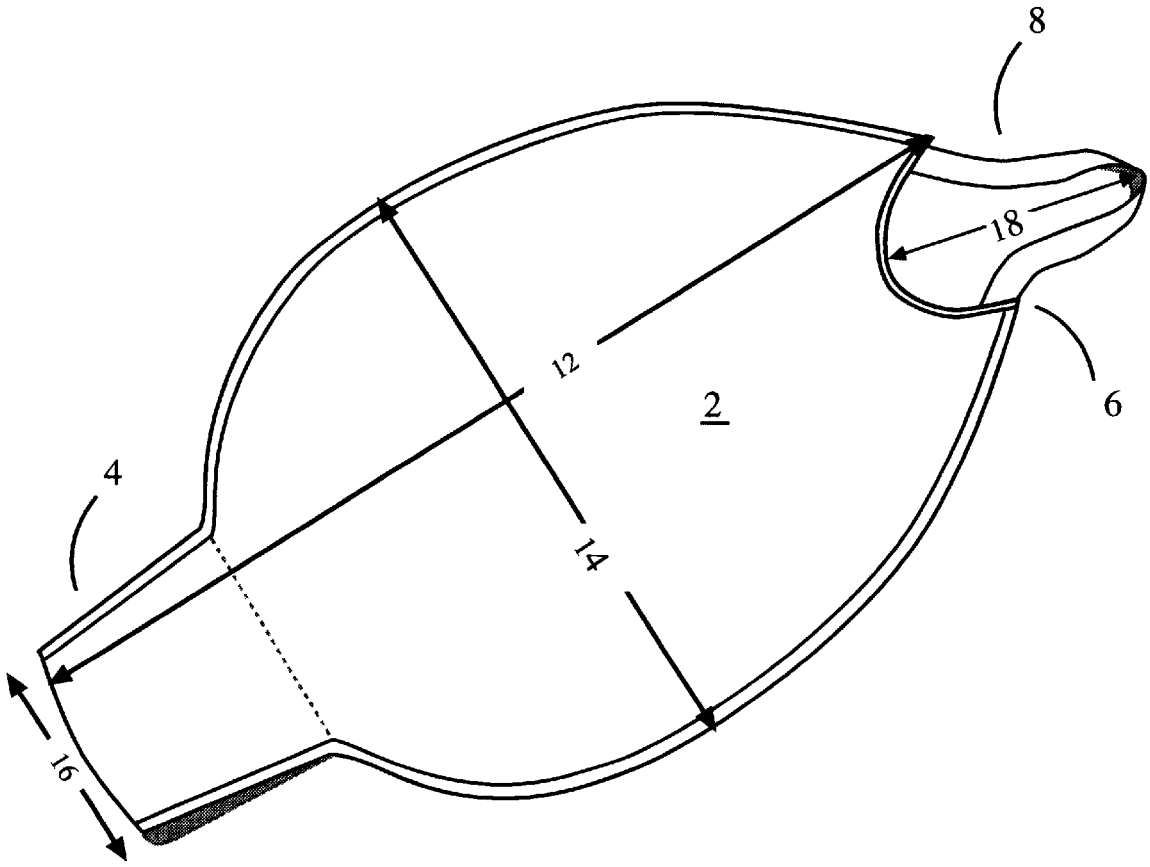
FIG. 1 shows a plan view of the blanket incorporating the invention which has been laid out flatly, before it has been put on by the mother.

In the preferred embodiment, the blanket is comprised of a single thickness fabric, the main body or midsection of which is an oval. FIG. 1 shows a plan view of the blanket incorporating the invention which has been laid out flatly. The blanket is comprised of a single thickness fabric, the main body or midsection of which is an oval. The reverse side or bottom of the blanket is flat and unornamented, with the exception of seam-binding edging. Blanket 2 (FIG. 1) is characterized in the illustration as having an oval midsection, which is trimmed in a cotton seam-binding border edging 10 on both rounded sides of the main body. The fabric which comprises the main body of the blanket is a soft, brushed flannel which can be imprinted with an ornamental checked pattern or design.

Both ends of the blanket taper to a reduced width to form the end of the oval, and at one end an arm-sleeve 4 (FIG. 1) is attached by a sewn seam. The arm-sleeve 4 is comprised of a single thickness of stretchable knit fabric, which extends from a stitched seam at the end of the blanket body, and folds over on itself, being symmetrical on the underneath side. The second or underneath side of the sleeve is then also stitched to the main body of the blanket. The sides of the arm sleeve are open, forming a short sleeve which fits over the mother's hand and onto the forearm, staying in place on the forearm, extending above the hand from the wrist and ending below the elbow. FIG. 2A shows a side view of the sleeve with side opening 20. In FIG. 2 shows the opening 22 from another angle for receiving the mother's arm.

The opposing end of the oval-shaped body of the blanket is also tapered to a reduced width and dips into a cutout armhole section. This cutout section 6 is shaped as a half-circle, and cuts into the body of the blanket at this end, as shown in FIG. 1. The arm hole is trimmed in ornamental cotton seam binding or edging. Attached to the top edges of the arm hole is the shoulder strap 8.

The shoulder strap 8, in the preferred embodiment, is comprised of a double-layer of knit, stretchable fabric, made into a rectangular strap. The strap 8 is folded over on itself to form a double thickness loop of fabric and a finished seam. It is stitched at each end onto the top inside edges of the armhole 6. The shoulder strap 8 extends up in the opposite direction of the arm hole. The strap rests on the mother's shoulder, covering across the front of her shoulder and extending across to her back shoulder, and the attached armhole goes underneath her shoulder and under her armpit.

REFERENCE NUMERALS IN DRAWINGS

2 Body of the blanket.
4 Arm sleeve of the blanket.
6 Arm hole of the blanket.
8 Shoulder strap.
10 Ornamental trim or seam binding.
12 Length of blanket.
14 Width of the blanket.
16 Width of arm sleeve.
18 Length of arm hole to top of shoulder strap.
20 Perspective view of arm sleeve-top.
22 Perspective view of arm sleeve-side view.
24 Body of the blanket shown in use.
26 Shoulder strap shown in use.
28 Arm sleeve shown in use on mother's arm.
30 Infant head shown in place for nursing.

Operation

Figure 3:
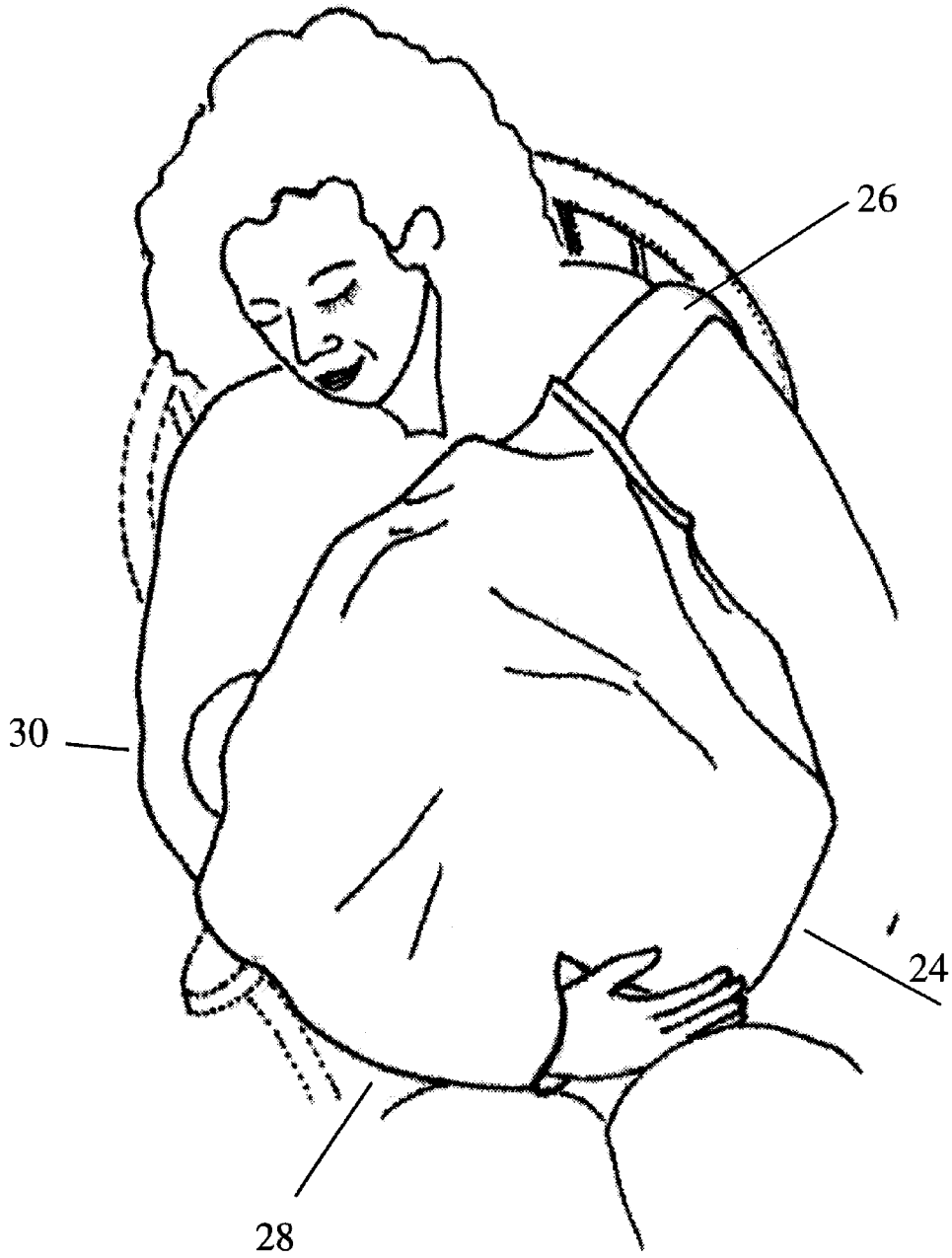
FIG. 3 shows the nursing blanket in use, attached to the mothers arms, covering her torso and the nursing infant.

The general composition and shape of the blanket now having been described, its use is depicted in FIG. 3, which is a view of the blanket being used by a nursing mother. To use the blanket, the mother first slides her arm, which will support the baby's head, into the arm-sleeve 28. She then lays the baby's head on this arm and brings the blanket up and around the infant's head 30 and body. The mother then extends the blanket 24 across the length of the infant's body, and the blanket simultaneously covers the mother's chest area (the infant is laying on her lap in position for nursing). The mother then grasps the opposing end of the blanket, or shoulder strap 26 in her opposite hand, slides her arm through the shoulder strap and onto her shoulder, where it wraps around the front and back of her shoulder. The armhole 6, FIG. 1, which is attached to the shoulder strap at the same end of the blanket rests underneath the mother's armpit.

Once the blanket is put on, it covers the mother's torso, as well as the infant's head and the majority of the infant's body. The baby's head rests on the arm which is covered by the arm sleeve, and the blanket then comes up and over the baby's head, and crosses his body.

The mother then proceeds to begin nursing her baby, without exposing her breast or the infant. Because the blanket is secured by the arm-sleeve on one end, and the shoulder strap on the opposing end, the blanket stays in place to provide privacy while nursing. The mother's hands are free to adjust the blanket as needed while nursing to give her a view of the infant and to monitor the feeding.

These following sewing instructions are provided to enable one skilled in the art to produce the preferred embodiment and best mode contemplated as described in this detailed description and illustrated herein. However, the scope and limitations of this invention are to be determined by the claims and not by the preferred embodiment and best mode contemplated described and illustrated.

Sewing Instructions

Figure 4:
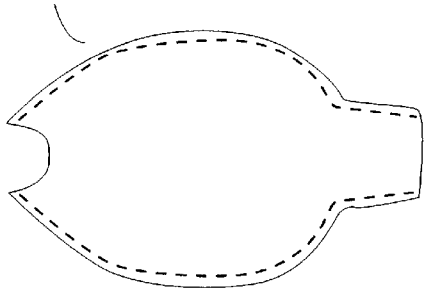
FIGS. 4A–G shows the step by step assembly of the blanket.
Figure 4:
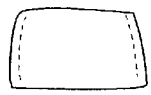
Figure 4:
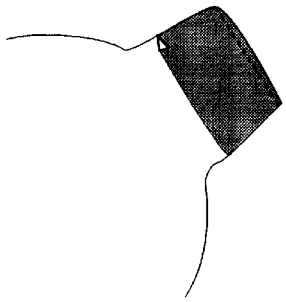
Figure 4:
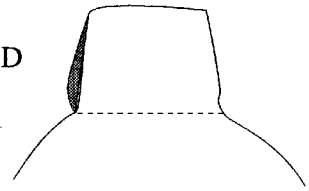
Figure 4:
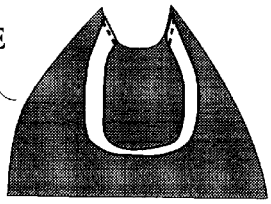
Figure 4:
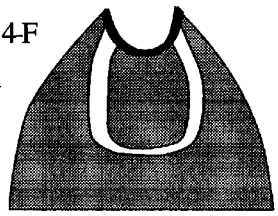
Figure 4:
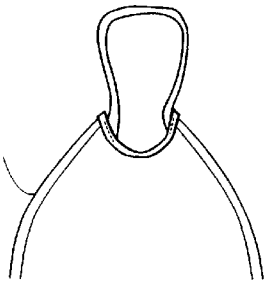

FIG. 4-A. Apply seam binding along sides of blanket.

FIG. 4-B. Using elastic thread on bobin, finish side edges of arm sleeve by stitching folded edges down. If possible, stitch shoulder strap with elastic thread on bobin, right sides together, along long edges using a stitch less than ⅝ seam. Turn strap right side out, leaving both ends open.

FIG. 4-C Remove elastic thread and stitch top of arm sleeve, right sides together to top of blanket.

FIG. 4-D Fold sleeve over to wrong side of blanket, and stitch bottom edge to blanket across the bottom sleeve.

FIG. 4-E Stitch shoulder strap to wrong side of curved sleeve arm hole cutout, on blanket, starting inside seam binding.

FIG. 4-F Finish edge of arm hole with seam binding, place over and catching up ends of strap, while strap is hanging down towards blanket.

FIG. 4-G Fold strap up, and stitch in position along top edge of seam binding.

What is claimed is:

1. A nursing blanket comprising:

a body in the shape of an oval having a first end and a second end at opposing ends of said oval;

a shoulder strap attached on said first end of said body for fitting over a shoulder of a nursing mother; and a sleeve, said sleeve attached to said second end of said oval, said sleeve having an opening at one side of said sleeve and extending through in a direction of the first end, said sleeve receiving a nursing mother's forearm, thereby covering the mother's breast and torso, and most of the baby's body during nursing with said nursing blanket.

2. The nursing blanket as set forth in claim 1 further comprising an arm hole cutout at said first end of said body.

3. The nursing blanket as set forth in claim 1 in which said body comprises a single layer of a soft brushed flannel material having an oval midsection tapering to a reduced width to form said first end and said second end.

4. The nursing blanket as set forth in claim 3 further comprising seam binding edging along a perimeter of said body.

5. The nursing blanket as set forth in claim 1 in which said shoulder strap comprises a rectangular strap made with a double layer of a stretchable fabric folded over itself lengthwise and stitched to form a finished edge, with ends of said strap stitched to said first end of said body.

6. The nursing blanket as set forth in claim 1 in which said sleeve comprises a length of stretchable knit fabric folded over on itself to join ends of said fabric, with said joined ends stitched to said second end of said body, thereby forming a sleeve with an opening at sides of said sleeve and extending latterly through said sleeve.

7. A nursing blanket comprising:

a body in the shape of an oval having a first end and a second end at opposing ends of said oval;

an arm hole cutout at said first end of said body;

a shoulder strap having ends, with said ends attached to said first end of said body at opposing apexes of said arm hole cutout, for fitting over a shoulder of a nursing mother; and a sleeve, said sleeve attached to said second end of said oval, said sleeve having an opening at one side of said sleeve extending through in a direction of the first end, said sleeve receiving a nursing mother's forearm, thereby covering the mother's breast and torso, and most of the baby's body during nursing with said nursing blanket.

8. A nursing blanket comprising:

a body, said body comprises a single layer of a soft brushed flannel material having an oval midsection tapering to a reduced width to form a first end and a second end at opposing ends of said oval;

seam binding edging along a perimeter of said body;

an arm hole cutout at said first end of said body;

a shoulder strap having ends, said shoulder strap comprising a rectangular strap made with a stretchable fabric formed by folding itself over lengthwise and stitched to form a finished edge, with said ends of said strap stitched to said first end of said body at opposing apexes of said arm hole cutout, for fitting over a shoulder of a nursing mother; and a sleeve, said sleeve comprising a length of stretchable knit fabric folded over on itself to join ends of said fabric, with said joined ends stitched to said second end of said body, thereby forming a sleeve with an opening at one side of said sleeve and extending through in a direction of the first end, said sleeve, thereby covering the mother's breast and torso, and most of the baby's body during nursing with said nursing blanket.

* * * * *